US005626423A

United States Patent [19]

Rumph

[11] Patent Number: 5,626,423

[45] Date of Patent: May 6, 1997

[54] APPARATUS AND METHOD FOR TRANSPORTING AND AGITATING A SUBSTANCE

[75] Inventor: Robert M. Rumph, Sumter, S.C.

[73] Assignee: The Maitland Company, Sumter, S.C.

[21] Appl. No.: 378,799

[22] Filed: Jan. 30, 1995

Related U.S. Application Data

[63] Continuation-in-part of Ser. No. 294,495, Aug. 23, 1994, Pat. No. 5,385,402, which is a continuation of Ser. No. 175,726, Dec. 30, 1993, Pat. No. 5,340,213, which is a continuation of Ser. No. 939,424, Sep. 4, 1992, Pat. No. 5,275,487, which is a continuation of Ser. No. 622,104, Dec. 4, 1990, abandoned.

[51] Int. Cl.[6] ..... B01F 7/20

[52] U.S. Cl. ..... 366/270; 366/297; 366/191

[58] Field of Search ..... 366/102, 103, 366/104, 196, 262, 263, 264, 265, 270, 292, 297, 299, 302, 348, 64, 65, 261, 298, 300, 301, 244, 245, 247, 249, 250, 251, 279, 603, 343, 61, 285, 286; 137/268

[56] References Cited

U.S. PATENT DOCUMENTS

| | | |
|---|---|---|
| 155,212 | 9/1874 | White . |
| 429,484 | 6/1890 | Schillinger . |
| 510,545 | 12/1893 | McLennan . |
| 539,288 | 5/1895 | McLennan . |
| 912,125 | 2/1909 | Hassam . |
| 1,192,478 | 7/1916 | Vandercook . |
| 1,276,383 | 8/1918 | Ludekens . |
| 1,313,361 | 8/1919 | White . |
| 1,618,669 | 2/1927 | Morrell . |
| 1,652,960 | 12/1927 | Snelling et al. . |
| 1,872,622 | 8/1932 | Donahue . |
| 1,893,451 | 1/1933 | Smith . |
| 1,896,616 | 2/1933 | Gillican . |
| 1,915,757 | 6/1933 | Pierce . |
| 1,981,010 | 11/1934 | Torson . |
| 2,052,544 | 9/1936 | Bartholomew . |
| 2,053,876 | 9/1936 | Pfau et al. . |
| 2,081,850 | 5/1937 | Darby et al. . |
| 2,081,851 | 5/1937 | Darby et al. . |
| 2,081,852 | 5/1937 | Darby et al. . |
| 2,108,416 | 2/1938 | Smith et al. . |
| 2,128,873 | 8/1938 | Roberts . |
| 2,210,160 | 8/1940 | Beal . |
| 2,277,890 | 3/1942 | Steindorf . |

(List continued on next page.)

FOREIGN PATENT DOCUMENTS

| | | | |
|---|---|---|---|
| 152558 | 7/1953 | Australia . | |
| 637579 | 4/1962 | Italy . | |
| 30-63313 | 5/1955 | Japan . | |
| 0997775 | 2/1983 | U.S.S.R. | 366/292 |
| 8164 | of 1909 | United Kingdom . | |
| 149585 | 8/1920 | United Kingdom . | |
| 784525 | 10/1957 | United Kingdom . | |
| 1214810 | 12/1970 | United Kingdom . | |

OTHER PUBLICATIONS

"Industrial Sealing Technology," Hugo Butcher, Jul. 23, 1986, p. 126.

Affidavit of Otto Ewers dated Jul. 7, 1994, with attachment "Exhibit A".

Affidvit of Sid Morrison dated Jul. 6, 1994.

*Primary Examiner*—David Scherbel

*Assistant Examiner*—Randall Chin

*Attorney, Agent, or Firm*—Finnegan, Henderson, Farabow, Garrett & Dunner, L.L.P.

[57] ABSTRACT

An apparatus and method is disclosed for transporting and agitating a substance having solid and liquid constituents. The apparatus includes a mobile wheeled chassis having a pressure vessel mounted thereon. The vessel has a floor and at least one wall with an inner surface defining a vessel interior space for containing the substance. A plurality of supports are located within the interior space and mounted to the inner surface. A plurality of motors each having a shaft are located and mounted to a respective support. A plurality of agitator blades are each coupled to a respective shaft and rotated about a substantially vertical axis for directing the substance toward the floor.

25 Claims, 3 Drawing Sheets

U.S. PATENT DOCUMENTS 2,322,720 6/1943 Scott et al. .
2,345,163 3/1944 Vollrath ..... 366/261
2,411,138 11/1946 Roberts .
2,522,077 9/1950 Wahl et al. .
2,574,958 11/1951 Carr ..... 366/285
2,609,185 9/1952 Eisner .
2,635,859 4/1953 Dreyfus .
2,768,011 10/1956 Mosher .
2,872,166 2/1959 Roberts .
2,891,675 6/1959 Kaplon .
2,965,364 12/1960 Parker et al. .
3,111,954 11/1963 Duncan .
3,139,100 6/1964 Griparis .
3,165,300 1/1965 Balistrieri .
3,170,675 2/1965 Cairnie .
3,180,628 4/1965 Pullin .
3,194,639 7/1965 Brown et al. .
3,211,436 10/1965 Butterfield .
3,235,232 2/1966 Conover .
3,259,261 7/1966 Gallagher .
3,312,476 4/1967 Eckerle et al. .
3,321,190 5/1967 Mott .
3,368,723 2/1968 Hardeman .
3,379,415 4/1968 Logue .
3,424,438 1/1969 Knotts et al. .
3,469,824 9/1969 Futty et al. .
3,559,595 2/1971 Appelhans .
3,584,842 6/1971 Sukup ..... 366/261
3,642,254 2/1972 Ternes .
3,684,250 8/1972 Roeser .
3,697,053 10/1972 Will ..... 366/343
3,748,081 7/1973 Hummell .
3,756,170 9/1973 Lang .
3,810,604 5/1974 Reiter .
4,023,777 5/1977 Kimmel .
4,032,261 6/1977 Madan .
4,060,224 11/1977 Wilson .
4,082,227 4/1978 McGrane et al. .
4,120,051 10/1978 Lohning .
4,157,872 6/1979 Davido, Sr. .
4,187,029 2/1980 Canale et al. .
4,223,622 9/1980 Mazzucato et al. .
4,298,289 11/1981 Walley .
4,329,069 5/1982 Graham .
4,390,286 6/1983 Regaldo .
4,407,622 10/1983 Ito .
4,410,279 10/1983 Howden et al. .
4,412,747 11/1983 Moriyama .
4,415,164 11/1983 Johnson .
4,416,545 11/1983 Krimmel .
4,416,549 11/1983 Kretschmer .
4,431,597 2/1984 Cramer et al. .
4,441,824 4/1984 Brokaw .
4,464,259 8/1984 Cramer et al. .
4,519,714 5/1985 Johnson et al. .
4,542,992 9/1985 Markhart .
4,552,460 11/1985 Wallace .
4,555,063 11/1985 Goettsch .
4,571,091 2/1986 Pardo et al. .
4,599,004 7/1986 Keith .
4,642,138 2/1987 Kayase et al. .
4,660,987 4/1987 Robinson .
4,671,872 6/1987 Cramer et al. .
4,685,868 8/1987 Bodensteiner et al. .
4,721,392 1/1988 Fries et al. .
4,746,221 5/1988 Okumura et al. .
4,756,626 7/1988 Neier .
4,786,001 11/1988 Ephraim et al. .
4,944,600 7/1990 McKelvey .
4,956,100 9/1990 Mikkleson ..... 366/251
4,981,366 1/1991 Wickoren .
4,989,504 2/1991 Jay .
5,005,364 4/1991 Nelson .
5,078,799 1/1992 Matter et al. .
5,094,540 3/1992 Face, Jr. .
5,147,133 9/1992 White .
5,269,604 12/1993 Ewers .
5,282,681 2/1994 Supelak ..... 366/244
5,340,214 8/1994 Juzwiak ..... 366/292
5,366,289 11/1994 Supelak ..... 366/244

APPARATUS AND METHOD FOR TRANSPORTING AND AGITATING A SUBSTANCE

CROSS-REFERENCE TO RELATED APPLICATIONS

This application is a continuation-in-part of application Ser. No. 08/294,495, filed on Aug. 23, 1994 (now U.S. Pat. No. 5,385,402), which is a continuation of application Ser. No. 08/175,726, filed on Dec. 30, 1993 (now U.S. Pat. No. 5,340,213), which is a continuation of application Ser. No. 07/939,424, filed on Sep. 4, 1992 (now U.S. Pat. No. 5,275,487), which is a continuation of application Ser. No. 07/622,104, filed on Dec. 4, 1990 (now abandoned). Each of these disclosures is relied upon and incorporated herein by reference.

BACKGROUND OF THE INVENTION

1. Field of the Invention

The present invention relates to an apparatus and method for transporting and agitating a substance having solid and liquid constituents.

2. Description of Related Art

Many industrial processes require raw materials consisting of solid and liquid mixtures. For example mixtures, such as calcium carbonate in water or clay water slurries, are extremely difficult to transport and store because dense solid materials settle on the bottom of storage containers during transportation and/or storage. When the container is drained the liquid portion of the mixture is readily removed, but a portion of the solid sediment remains in the storage container. Thus it is difficult to completely unload all of the solid material.

Calcium carbonate is a substance used as a component in a number of common household medical products such as antacid and toothpaste. Additionally, the paper industry uses this material as a substitute for wood pulp paper filler to eliminate the need for unnecessary destruction of forestry. Because of the great demand for the end products produced by these industries, extremely large quantities of calcium carbonate must be transported.

Calcium carbonate is mined from the earth in large boulders, and crushed to create a fine powder substance. This powder is then normally mixed with water to create a solid and liquid suspension that is relatively easy to handle. The calcium carbonate and water mixture is loaded in transportation devices, such as railroad tank cars for shipping.

While the solid and liquid mixture is within the tank of a transportation device, the calcium carbonate solid material settles in the liquid and gradually forms a sediment on the bottom of the tank. This solid sediment is extremely difficult to remove from the tank when the tank is unloaded. The retention of solids in the bottom of the tank poses numerous disadvantages. First, the backhaul of the tank to pick up another load requires unnecessary rehauling of the solids back to the original pickup point, making the tank heavier and wasting fuel. Additionally, the build-up of solids reduces the capacity of the tank so that each subsequent refill of the tank includes less and less volume. Therefore it is desirous to remove all of the settled solid material along with the liquid when the mixture is unloaded. This removal process, however, is normally an extremely time consuming and expensive process.

Some previous attempts to deal with this problem have met with limited success. In one removal process, a worker introduces a pressurized air hose through the opening of a tank and passes the open end of the hose along the bottom of the tank. The pressurized air circulates through the solid material to mix the solid with the liquid. This process is extremely inefficient, because a worker is required to pass the open end of the hose along the entire bottom surface of the tank in a time consuming procedure.

Additionally, sparger systems have been used on tank cars to recirculate a substance within a tank. These systems include a pipe positioned along the floor of a tank and having small holes along its length. This pipe is either connected to a source of compressed air or a fluid pump. When the product within the tank is nonflammable, the tank is vented and the compressed air is blown in the pipe to emit air bubbles from the holes for mixing the products in the tank. If a flammable product is within the tank, the material is recirculated in the tank by pumping liquid from the top of the tank into the pipe and allowing the liquid to flow through the holes into the bottom of the tank. These sparger systems have met with limited success, because settled solid material is not adequately mixed unless it is an extremely lightweight powder. Further, the small holes in the pipe are prone to clogging with solid material that has settled in the tank.

Because many of the current means for unloading solid and liquid mixtures are time consuming, large storage tanks having agitators are required at destination sites. These storage tanks maintain solid and liquid materials in a mixture form for immediate use in an industrial process, however, these on-site tanks could be eliminated if a solid and liquid mixture was able to be immediately unloaded from a transportation tank.

U.S. Pat. No. 1,652,960 to Snelling et al. discloses a tank for transporting materials along a railway. This tank has a series of rotatable agitating blades mounted to vertical shafts that extend through a top wall of the tank. These shafts are rotated by a horizontal drive shaft that is positioned on the tank exterior and connected to a belt pulley. Because the vertical shafts extend through a wall of the tank, complicated drive connections, bearings and seals are required. Additionally, it is often important to pressurize the vessel to facilitate unloading. However, because the shafts pass through the tank wall, it would be difficult if not impossible to comply certain Department of Transportation regulations as well as the American Society of Mechanical Engineers' pressure vessel standards.

SUMMARY OF THE INVENTION

Accordingly, the present invention is directed to an apparatus and method for transporting and agitating a substance having solid and liquid constituents that substantially obviates one or more of the limitations of the related art.

To achieve these and other advantages and in accordance with the purpose of the invention, as embodied and broadly described herein, the invention includes an apparatus and method for transporting and agitating a substance having solid and liquid constituents. The apparatus comprises a chassis having rotatable wheels, a pressure vessel mounted on the chassis and having at least one wall with an inner surface defining an interior space for containing the substance, the vessel having a ceiling, floor and an intermediate region between the ceiling and floor, a support located within the vessel interior space and mounted to the inner surface of the wall, a motor connected to the support and located entirely within the pressure vessel interior, the motor having a shaft positioned in a substantially vertical orientation and being operational in a pressurized environment, and an agitator blade located in the vessel interior and coupled to the shaft, the agitator blade being rotatable about a substantially vertical axis for directing the substance from the intermediate region toward the floor.

Preferably, the apparatus of the invention includes a plurality of motors located within the vessel interior at the intermediate region, each of the motors having a shaft and being mounted to a respective support, and each motor being capable of operation within a pressurized environment in a pressure vessel, and a plurality of agitator blades located in the vessel interior and spaced apart adjacent to the floor, each of the agitator blades being coupled to a respective shaft and being rotatable about a substantially vertical axis for directing the substance from the intermediate region toward the floor, the agitator blades being oriented so that when the blades are rotated substantially the entire floor is covered by rotating blades.

Additionally, the present invention includes a method of transporting a substance having solid and liquid constituents. The method comprises the steps of conveying a substance into a pressure vessel having a plurality of agitators located therein, each agitator including a motor, a substantially vertically oriented shaft, and a blade, the shaft having opposing ends entirely contained within the pressure vessel and the motor being located entirely within the pressure vessel and being capable of operation within the pressure vessel when pressurized, transporting the vessel to a destination and permitting at least some of the solids to settle and form a sediment on a floor portion of the pressure vessel, rotating the blades with the motors to drive liquid toward the floor to agitate the sediment and causing the sediment to mix with the liquid, thereby forming a substantially uniform mixture of solids and liquids in the pressure vessel, pressurizing the pressure vessel, and off-loading the substance by opening a port in the pressure vessel when the vessel is pressurized.

It is to be understood that both the foregoing general description and the following detailed description are exemplary, and are intended to provide further explanation of the invention as claimed. The accompanying drawings are included to provide a further understanding of the invention and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
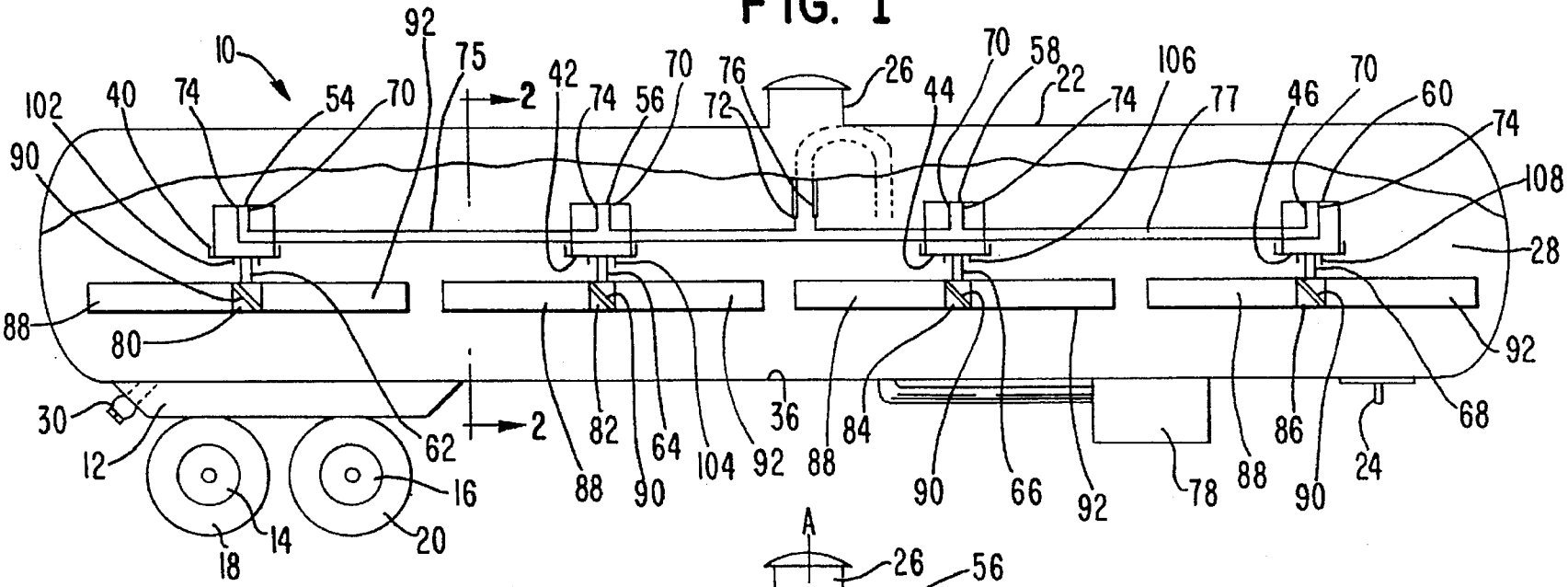
FIG. 1 illustrates a first embodiment of the invention wherein a wall of the pressure vessel is partially cut away to illustrate details of the vessel interior.

Reference will now be made in detail to the present preferred embodiments of the invention, examples of which are illustrated in the accompanying drawings. Wherever possible, the same reference numbers are used in the drawings and the description to refer to the same or like parts.

In accordance with the invention, there is provided an apparatus for transporting and agitating a substance having solid and liquid constituents the apparatus including a chassis having rotatable wheels. As embodied herein and as illustrated in FIG. 1, the apparatus may include a tanker trailer 10 having a chassis 12. The chassis 12 has rotatable wheels 14, 16 each having a tire 18, 20 respectively mounted thereon for transporting the apparatus 10 along a road surface. The chassis 12 also includes a pin 24 enabling the chassis 12 to be connected to a tractor or truck.

In accordance with the invention, a pressure vessel having a ceiling, intermediate region, floor and at least one wall is mounted on the chassis. As embodied herein and as shown in FIG. 1, the tanker trailer 10 includes pressure vessel 22 mounted on chassis 12. While vessel 22 is illustrated in the drawings as a straight tank, this illustration is not intended to limit the claimed invention. Vessel 22 may be of any other shape including tanks referred to by one or more of the following terms: drop bottom, drop belly, double conical, or other commonly known or commercially available tankers. A manway collar 26 provides a resealable hatchway access into the interior 28 of the vessel 22, and a discharge passage 30 allows for removal of substances from the vessel 22. While FIG. 1 illustrates a rear discharge port, the invention, in its broadest sense is not so limited. Center, drop bottom, drop center, and other convention discharge port locations are also contemplated in accordance with the invention.

The pressure vessel 22 has a wall 32 surrounding the vessel interior 28 (see FIG. 2) to form an enclosed volume. The wall 32 defines a ceiling 34 at an uppermost region and a floor 36 at a lowermost region, while an intermediate region 38 is positioned therebetween. Preferably the vessel 22 may be constructed to meet the United States Department of Transportation's Standards for transportation of hazardous waste. Preferably the vessel 22 may be constructed as a pressure vessel conforming to the standards for pressure vessels established by the American Society of Mechanical Engineers. In a preferred embodiment of the invention, the pressure vessel 22 is configured to operate with an internal working pressure of 10 pounds per square inch (psi) or greater to allow for off-loading of substances from the vessel by internal pressurization. Any passages including discharge 30 through the vessel wall 32 must have sufficient seals to allow for this pressurization. Therefore, other than for hydraulic lines 72, 76 passing through the manway collar 26 as described below, vessel wall 32 preferably contains no perforations, such as passages for rotating drive shafts.

Figure 2:
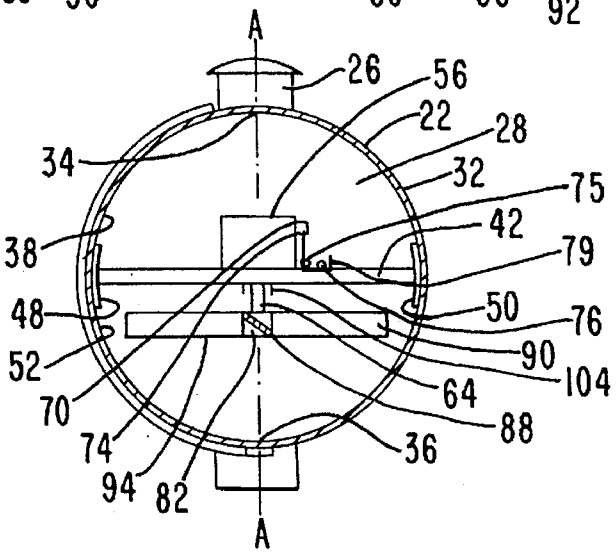
FIG. 2 is a cross-sectional view taken along line 2—2 of FIG. 1.

The vessel wall 32 is preferably fabricated from a non-corrosive material, such as 307 stainless steel or a material of similar or greater durability. As shown in FIGS. 1 and 2, the vessel wall 32 has a substantially circular cross section and forms a pressure vessel 22 having an elongated cylindrical shape. Preferably the length of the pressure vessel 22 is between 15 feet and 75 feet, while the cross sectional diameter is between 6 feet and 12 feet. The pressure vessel shape, and dimensions for the apparatus 10 shown in FIGS. 1 and 2 are merely illustrative of a preferred embodiment of the invention. Additional shapes, cross sections and dimensions for the pressure vessel 22 are envisioned. Further, the pressure vessel 22 could be formed from a plurality of walls (not shown) that have edges joined with welded seams.

In accordance with the invention a support is located within the pressure vessel and mounted to the inner surface of the vessel wall. As embodied herein and shown in FIGS. 1 and 2, the apparatus includes a plurality supports 40, 42, 44, 46 suspended within the interior 28 of the pressure vessel 22. In the preferred embodiment, each of the supports 40, 42, 44, 46 is an elongated piece of channel steel having a U-shaped cross section. A hole (not shown) is arranged through the center of each of the supports 40, 42, 44, 46 for receiving substantially vertically oriented motor shafts 62, 64, 66, 68 as described below.

As depicted in FIG. 2, a pair of mounting pads 48, 50 at opposite ends of support 42 are welded to the interior surface 52 of the pressure vessel wall 32 in the intermediate region 38 and at a position approximately half way between the ceiling 34 and floor 36. This similar attachment structure is employed for each of the supports 40, 42, 44, 46. Each support 40, 42, 44 and 46 is completely contained within the interior space 28 and does not substantially obstruct fluid flow in the vessel 22.

In accordance with the invention, a motor having a substantially vertically oriented shaft is mounted to a support. As embodied herein and shown in FIG. 1, a plurality of motors 56, 58, 60 are each respectively mounted on supports 40, 42, and 46. Bolts (not shown) or other fastening means may be used for this mounting. Each of the motors 54, 56, 58, 60 is positioned approximately equidistant between the ceiling 34 and floor 36 at approximately the center of the cross section of the vessel 22, as shown in FIG. 2. Motors 54, 56, 58, 60 each have a rotatable shaft 62, 64, 66, 68 respectively extending through holes (not shown) in the center of supports 40, 42, 44, 46. The shafts 62, 64, 66, 68 assume a generally vertical orientation facing the floor 36. In a preferred embodiment, bearings are not required between the shafts 62, 64, 66, 68 and the respective supports 40, 42, 44, 46, because each motor 54, 56, 58, 60 has internal bearings (not shown), such as those commonly found in wheel motors.

The motors 54, 56, 58, 60 and the shafts 62, 64, 66, 68 are contained entirely within the vessel interior 28 and are constructed so that they are capable of being operated within this pressurized environment. Motors capable of being operated while totally submerged are preferred. Additionally, because the pressure vessel 22 may frequently contain flammable substances, the motors 54, 56, 58, 60 are preferably non spark generating.

In a preferred embodiment, as shown in FIGS. 1 and 2, each of the motors 54, 56, 58, 60 is a hydraulic motor having a hydraulic fluid inlet 70 coupled to an inflow hydraulic fluid conduit 72 and a hydraulic fluid outlet 74 coupled to an outflow fluid conduit 76. The motors preferably contain VITON™ seals, known in the art. Such motors are commercially available under the trade name CHAR-LYNN™.

As shown in FIG. 1, the motors 54, 56 and motors 58, 60 are connected in series, the hydraulic fluid outlets 74 of motors 56, 58 being respectively interconnected with hydraulic fluid inlets 70 of motors 54, 60 by conduits 75, 77. This arrangement allows each of the motors 54, 56, 58, 60 to be energized with a single inflow hydraulic fluid conduit 72 and a single outflow hydraulic fluid conduit 76. When the hydraulic motors 54, 56, 58, 60 are connected in series as shown in FIG. 1, the intermediate motors 56, 58, may each have a k-strain line (not shown) connected to the outflow conduit 76 to reduce the hydraulic fluid pressure within the motor and prevent motor seal failure. The hydraulic fluid conduits 72, 76 pass through the manway collar 26 in a sealed fluid-tight fashion. This passage through the pressure vessel 22 does not compromise the integrity of the pressure vessel 22 for if external portions of conduits 72 or 76 were to shear, only hydraulic fluid would leak.

The hydraulic fluid conduits 72, 76 are coupled to a hydraulic fluid pump 78 in order to circulate the fluid through the conduits and energize the motors 54, 56, 58, 60. As shown in FIG. 1, the hydraulic fluid pump 78 may be mounted directly to the outside of the pressure vessel 22. Optionally, the fluid conduits 72, 76 may terminate outside of the vessel 22 at valved connectors (not shown) that are capable of being connected through flexible hoses and quick couplings to a hydraulic fluid pump completely separate from the vessel 22.

As shown in FIG. 2, a beam 79 having an L-shaped cross section may be arranged within the tank interior 28 on supports 40, 42, 44, 46 between each of the motors 54, 56, 58, 60 for supporting the hydraulic fluid conduits 72, 75, 76, 77 along the length of the pressure vessel 22. The hydraulic fluid conduits 72, 75, 76, 77 may be mounted to the beam 79 through the use of brackets or other mounting structures (not shown) to reduce conduit vibration and movement.

Although the preferred embodiment includes hydraulic motors, other types of motors may be appropriate for some applications. For example, air driven motors or submersible electric motors may be used within the pressure vessel 22.

Figure 3:
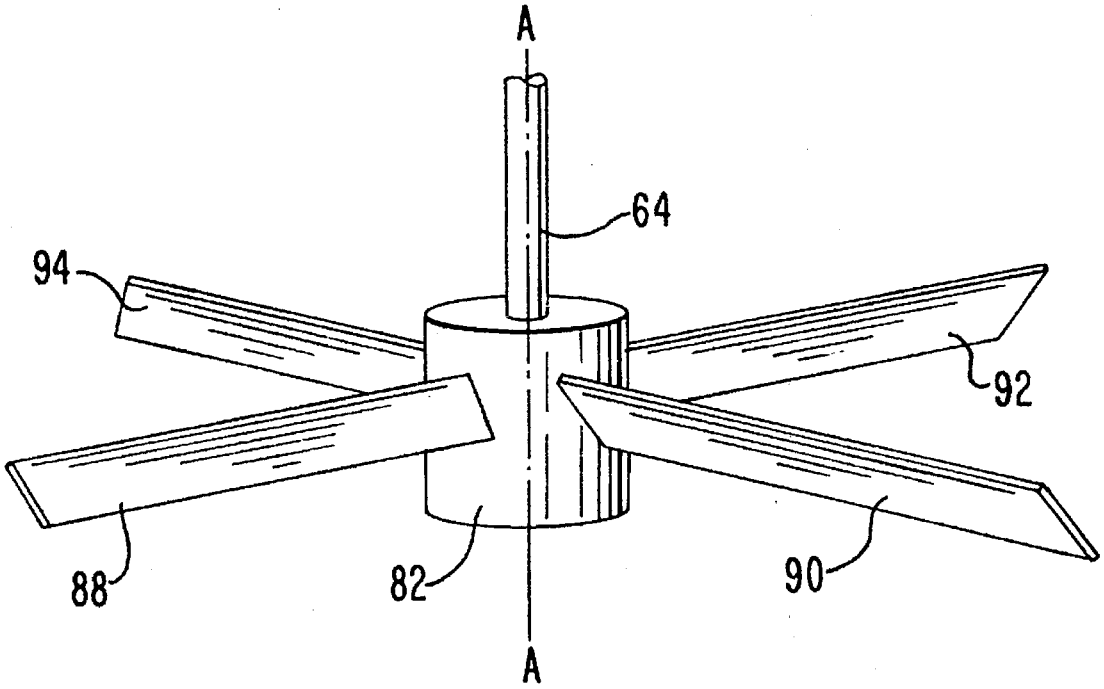
FIG. 3 is an oblique view of the agitator blades and hub shown in FIG. 2.

In accordance with the invention an agitator blade is coupled to the motor shaft for rotation about a substantially vertical axis and to direct substances toward the floor of the pressure vessel. As embodied herein and as best illustrated in FIG. 3 with reference to a single set of blades, hub 82 is mounted to the end of motor shaft 64. Four agitator blades 88, 90, 92, 94, are attached to hub 82. Each blade is oriented at a blade angle to a vertical axis A—A. This blade angle is preferably between 18° and 49°. In one embodiment of the invention used in connection with the transportation of calcium carbonate, the blade angle is approximately 34°. Each of hubs 80, 84 and 86, have blades mounted in a manner similar to the blades of hub 82.

Each of the blades 88, 90, 92, 94 has a length between 6 inches and 4 feet and a width between 2 inches and 8 inches. Preferably the blades 88, 90, 92, 94 are spaced no greater than 14 inches below each respective motor 54, 56, 58, 60 to reduce the amount of torque and bending moment applied to each of the shafts 62, 64, 66, 68. A preferred distance from the bottom of each blade to the lowest portion of floor 36 is about 40 inches. Although a preferred embodiment includes four agitator blades (as shown in FIG. 3) connected to each hub, the number of blades may range in number from 1 to 10 with a preferred range being between 4 and 10.

When the motors 54, 56, 58, 60 are energized, the blades 88, 90, 92, 94 rotate about a substantially vertical axis A—A. The rotating blades direct substances within the pressure vessel 22 from the intermediate region 38 toward the floor 36 to agitate the substance. Liquid above the blades 88, 90, 92, 94 is driven toward the floor 36 to mix with solid particle constituents formed into sediment on the floor 36. After the liquid is driven toward the floor 36, the solid and liquid mixture is forced along the interior surface 52 of the pressure vessel 22 toward the ceiling 34. Thus, all of the substance contained within the pressure vessel 22 is effectively blended to eliminate or significantly reduce the sediment on the floor 36.

When each set of blades is rotated, the rotational blade paths should cover a minimum of 15% of the floor. Preferably, the rotational blade paths cover substantially the entire floor 36 so that all of the floor area is subjected to the force of a rotating blade. As each set of blades rotates, they are preferably spaced apart by between 2 inches and 20 inches. In other words, the perimeters of the rotational paths are spaced apart by between 2 and 20 inches. Preferably when each blade rotates, tip ends of one set of rotating blades is no more than 48 inches from the tip ends of an adjacent set of rotating blades (i.e., perimeters of the rotation paths are no more than 48 inches from each other at their closest points). Additionally, when the blades rotate, their tips are spaced by no more than about 32 inches from the interior wall surface 52. In a preferred embodiment, the blade tip to wall spacing is 10 inches.

As depicted in FIGS. 1 and 2, sleeves 102, 104, 106, 108 surround each shaft 62, 64, 66, 68 respectively to prevent solids from damaging the motor seals. The sleeves 102, 104, 106, 108 are connected respectively at one end in a sealed fashion to motors 54, 56, 58, 60, although they may be alternatively sealingly connected to supports 40, 42, 44, 46. An open opposite end of each sleeve 102, 104, 106, 108 is positioned adjacent to the blades 88, 90, 92, 94. Each sleeve thereby forms a chamber around each of the shafts 62, 64, 66, 68. The sleeves 102, 104, 106, 108 trap a pocket of air around each of the shafts 62, 64, 66, 68 when the pressure vessel contains a substance. This trapped pocket of air inhibits substance from passing around each shaft 62, 64, 66, 68 and into each motor 54, 56, 58, 60.

In accordance with the invention, the apparatus may include a railcar chassis for transportation along railroad tracks. As illustrated in a second embodiment of the invention in FIG. 4, an apparatus 100 includes railcar chassis 112, 113 having rotatable railcar wheels 114, 115 and 116, 117 for transporting the apparatus along railroad tracks. A pressure vessel 122 mounted on the chassis 112, 113 has supports 140, 142, 144, 146, motors 154, 156, 158, 160, shafts 162, 164, 166, 168, agitator blades 188, 190, 192, hydraulic inflow conduit 172, hydraulic outflow conduit 176 and hydraulic fluid pump 178 configured as in the embodiment of FIG. 1. The arrangement of motors, supports, shafts, and blades is similar to that disclosed in connection with FIGS. 1–3.

In accordance with the invention, there is also provided a method of transporting a substance having solid and liquid constituents wherein a substance is conveyed into a pressure vessel having a plurality of agitators. This method is explained below with reference to the embodiments described above. However, it should be understood that the method of the invention is not limited to the structure disclosed herein.

A substance, for example calcium carbonate in water, having solid and liquid particles is conveyed into the pressure vessel 22 through the manway collar 26. The amount of substance conveyed into the pressure vessel 22 may be sufficient to partially or completely submerge each of the motors 54, 56, 58, 60. As the level of substance rises above the level of the opening in each sleeve 102, 104, 106, 108, a pocket of air is trapped around each of the motor shafts 62, 64, 66, 68. This air trapped around the motor shafts 62, 64, 66, 68 inhibits the passage of the substance into each of the motors.

Figure 4:
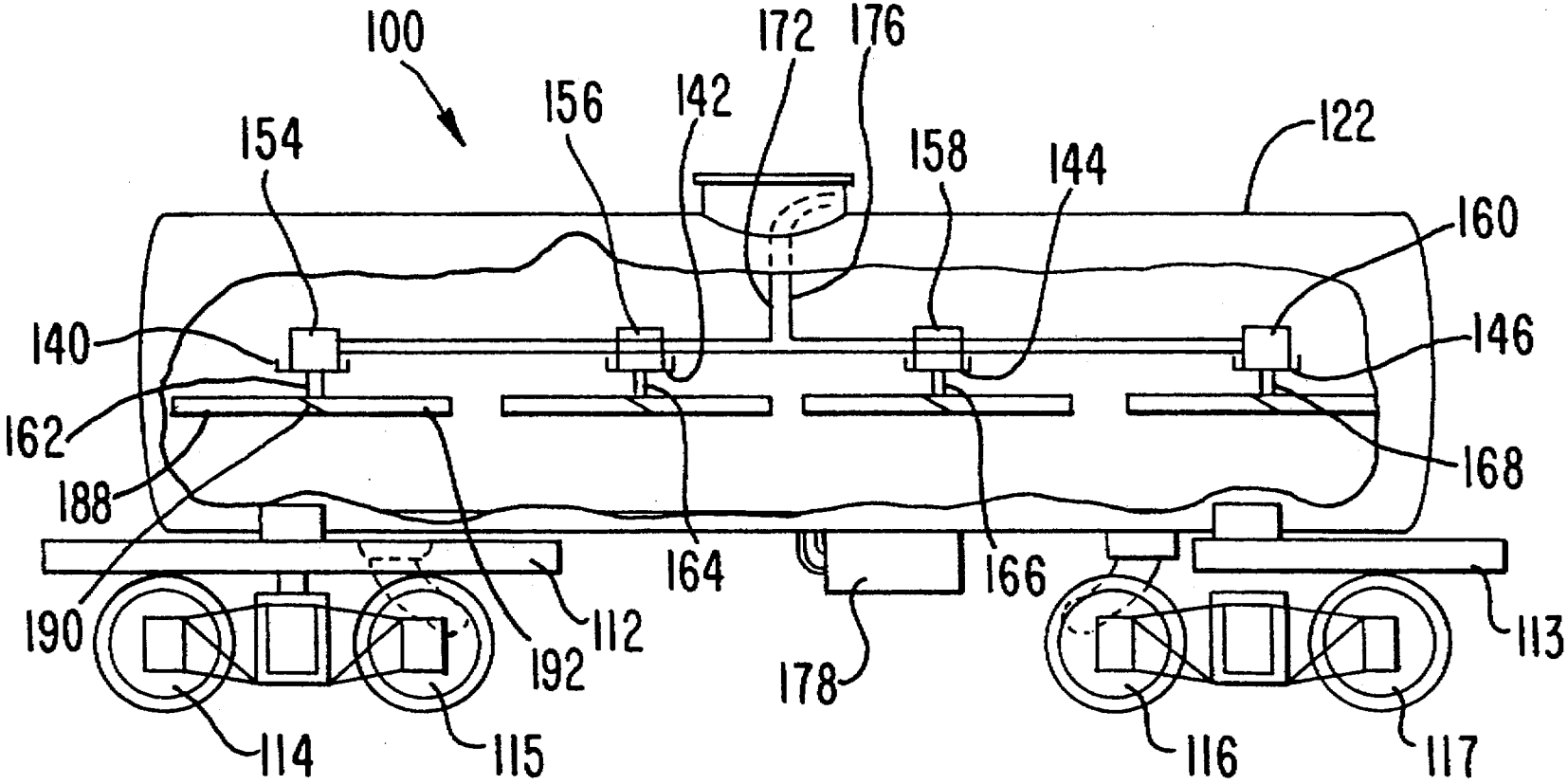
FIG. 4 illustrates a second embodiment of the invention wherein a wall of the pressure vessel is partially cut away to illustrate details of the vessel interior.

In accordance with the present invention, a pressure vessel is transported to a destination while at least some of the solids settle and form sediment. The pressure vessel 22 depicted in FIG. 1 is transported to a destination along a road surface by hauling the apparatus 10 with a truck or other power vehicle coupled to pin 24. Alternatively, railcar chassis 113, 114, as shown in the embodiment of FIG. 4, may be used to transport the pressure vessel 122 to a destination along railroad tracks. The motors 54, 56, 58, 60 are not activated to rotate the blades 88, 90, 92, 94 during at least a portion of the transportation process. Therefore, solid particles within the pressure vessel 22 settle to the floor 26 and form a sediment. This sediment can remain indefinitely within the pressure vessel, because the blades 88, 90, 92, 94 are positioned above the floor 36 at a position that is above a normal sediment level.

When the pressure vessel 22 is transported to a desired destination, the solid sediment on the floor 36 must be resuspended in the liquid to facilitate unloading of the pressure vessel 22. To resuspend the solid sediment, each of the motors 54, 56, 58, 60 is energized by a power source positioned exterior of the pressure vessel. With the embodiment of FIG. 1 for example, this step is accomplished by activating the hydraulic fluid pump 78 located on the exterior of the pressure vessel 22. Alternatively, this step may be accomplished by connecting the inflow and outflow hydraulic fluid lines 72, 76 through flexible hoses and quick couplings (not shown) to a hydraulic fluid pump (not shown) completely separate from the vessel 22.

If the power source is a hydraulic fluid pump such as pump 78, hydraulic fluid is circulated as follows: initially the hydraulic fluid is pumped through hydraulic fluid inflow conduit 72 into the hydraulic fluid inlets 70 on motors 56, 58; hydraulic fluid then flows from outlets 74 of motors 56, 58 through conduits 75, 77 and into inlets 70 of motors 54, 60; thereafter the hydraulic fluid flow from the outlets 74 on motors 54, 60 and into outflow conduit to return to the hydraulic fluid pump 78.

The blades 88, 90, 92, 94 attached to each of the hubs 80, 82, 84, 86 are rotated about a substantially vertical axis of rotation A—A when the motors 54, 56, 58, 60 rotate the respective shafts 62, 64, 66, 68. The blades 88, 90, 92, 94 rotate in an appropriate rotational direction to direct the substance within the pressure vessel 22 toward the floor 36. In a preferred embodiment, this blade rotation is at a rate of less than 250 RPM, with a preferred rate being approximately 75 RPM. Because the blades 88, 90, 92, 94 are relatively long and wide with respect to the size of pressure vessel 22, these low rotational speeds are possible. Thus, vibration and noise are reduced. Additionally, cavitation does not take place around the blades, enabling flammable substances to be agitated without the risk of explosion due to excessive aeration.

Initially when the blades 88, 90, 92, 94 are rotated, liquid and any light solids within the pressure vessel 22 is driven towards the floor 36. The liquid gradually peels off layers of solid particles from the sediment on the floor 36 to create a solid and liquid mixture that is forced upwards in the pressure vessel 22 by flowing up the interior wall surface 52. Thereafter, the rotating blades 88, 90, 92, 94 direct the mixture towards the floor 36. All of the substance within the pressure vessel 22 is recirculated in this fashion at least once during a six minute interval. Because the supports 40, 42, 44, 46 occupy a very small percentage of the total volume of the pressure vessel 22, they do not interfere with flow in the pressure vessel 22. The blade rotation is continued until all of the solid particles are removed from the floor 36 to create a homogeneous, substantially uniform, solid and liquid mixture.

When a uniform mixture of solids and liquids is attained within the pressure vessel 22, the substance is offloaded from the pressure vessel 22. Offloading preferable is accomplished using pressure. To this end, pressure vessel 22 is connected to a suitable pressurizing apparatus. Next, a port, such as discharge 30, is opened so that pressure in vessel 22 forces the mixture out of vessel 22. Effectively all of the solid particles within the pressure vessel 22 are removed along with the liquid in the practice of this invention.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. A method of transporting a substance having solid and liquid constituents, the method comprising the steps of:

conveying a substance into a pressure vessel having a plurality of agitators located therein, each agitator including a motor, a substantially vertically oriented shaft, and a blade, the shaft having opposing ends entirely contained within the pressure vessel and the motor being located entirely within the pressure vessel and being capable of operation within the pressure vessel when pressurized;

transporting the vessel to a destination and permitting at least some of the solids to settle and form a sediment on a floor portion of the pressure vessel;

rotating the blades with the motors to drive liquid toward the floor to agitate the sediment and causing the sediment to mix with the liquid, thereby forming a substantially uniform mixture of solids and liquids in the pressure vessel;

pressurizing the pressure vessel; and offloading the substance by opening a port in the pressure vessel when the vessel is pressurized.

2. The method of claim 1, further including the steps of connecting each motor to a power source positioned exterior of the vessel and energizing each motor.

3. The method of claim 2, wherein the motors are hydraulic motors and the power source includes a hydraulic fluid pump.

4. The method of claim 1, wherein the step of rotating includes recirculating all of the substance within the vessel at least once during a six minute interval.

5. The method of claim 1, wherein the step of rotating includes turning each blade at no greater than 250 RPM.

6. The method of claim 1, wherein the pressure vessel is located on a railcar chassis and the step of transporting includes moving the vessel on railroad tracks.

7. The method of claim 1, wherein the pressure vessel is located on a tired chassis and the step of transporting includes moving the vessel along a road surface.

8. The method of claim 1, wherein the step of conveying includes filling the vessel with the substance so that the motors are at least partially submerged in substance.

9. The method of claim 1, wherein the step of conveying further includes the substep of forming a pocket of air around the shafts to inhibit passage of substance into the motors.

10. An apparatus for transporting and agitating a substance having solid and liquid constituents, the apparatus comprising:

a chassis having rotatable wheels;

a pressure vessel mounted on the chassis, the vessel including a shell defining an interior space for containing the substance, the shell having a ceiling, a floor, and an intermediate region between the ceiling and floor, and a discharge passage located in said shell, the discharge passage being operable between an open position and a closed position, the vessel being constructed and pressure sealed to permit off-loading of the substance through said discharge passage by internal pressurization of said vessel when the discharge passage is opened;

a support mounted within the vessel interior space;

a motor connected to the support and located entirely within the pressure vessel interior space, the motor having a shaft positioned in a substantially vertical orientation and being operational in a pressurized environment; and an agitator blade located in the vessel interior space and coupled to the shaft, the agitator blade being rotatable about a substantially vertical axis for directing the substance from the intermediate region toward the floor.

11. The apparatus of claim 10, further including a hub mounted on the shaft, wherein the blade is positioned no greater than 14 inches below the motor, and the blade is directly connected to the hub.

12. The apparatus of claim 10, wherein the rotatable wheels are railcar wheels.

13. The apparatus of claim 10, wherein the motor is a submergible non-sparking motor.

14. The apparatus of claim 10, wherein the motor is a hydraulic fluid motor having internal bearings for the shaft.

15. The apparatus of claim 14, wherein the apparatus further includes an inflow hydraulic fluid conduit, a hydraulic fluid inlet of the hydraulic motor, an outflow hydraulic conduit, a hydraulic fluid outlet of the hydraulic motor, and at least one sealed passage through said shell, wherein the inflow conduit is coupled to the hydraulic fluid inlet, the outflow conduit is coupled to hydraulic fluid outlet, and the inflow and outflow conduits each extend through said at least one sealed passage.

16. The apparatus of claim 14, wherein the shell includes an inner surface and wherein the support is mounted on the inner surface of the shell at the intermediate region and the motor is located at a position being approximately equidistant between the floor and the ceiling.

17. The apparatus of claim 14, wherein the apparatus further includes a sleeve positioned around the motor shaft, the sleeve having opposite first and second ends, the first end being mounted to one of the motor and support, the second end being positioned adjacent to the blade, the sleeve forming a sealed chamber between the sleeve and shaft, the chamber having an opening at the second end.

18. An apparatus for transporting and agitating a substance having solid and liquid constituents, the apparatus comprising:

a mobile wheeled chassis;

a pressure vessel mounted on the chassis and having at least one wall with an inner surface defining a vessel interior space for containing the substance, the vessel having a ceiling, a floor, and an intermediate region positioned above the floor;

a plurality of supports located within the interior space above the floor;

a plurality of motors located within the vessel interior space, each of the motors being capable of operation within a pressurized environment in a pressure vessel;

a plurality of motor driven shafts, each associated with one of said plurality of motors and each being rotatable about a substantially vertical axis; and a plurality of agitator blades, each of said shafts having at least one of said plurality of blades rotatable therewith within the vessel interior space, such that each rotating blade has a tip end defining a perimeter of a circular path of blade travel, and wherein the agitator blades are oriented so that when the blades are rotated, substantially the entire floor is covered by rotating blades and substance in the intermediate region is directed towards the floor.

19. The apparatus of claim 18, further including a hub mounted on each shaft, wherein the blades are positioned no greater than 14 inches below a respective one of said plurality of motors.

20. The apparatus of claim 18, wherein the perimeters of adjacent circular paths of blade travel are spaced apart by between 2 inches and 20 inches.

21. The apparatus of claim 18, wherein the motors are disposed in the pressure vessel at a location approximately equidistant between the floor and the ceiling.

22. The apparatus of claim 18, wherein the perimeters of adjacent circular paths of blade travel are spaced apart by no more than 48 inches.

23. The apparatus of claim 18, wherein the perimeters of the circular paths of blade travel are spaced no more than 32 inches from an adjacent interior wall of the vessel.

24. The apparatus of claim 18, wherein the plurality of supports includes four supports and the plurality of motors includes four motors.

25. The apparatus of claim 18 wherein each shaft has an associated vertical axis and wherein the blade of each shaft is angled at approximately 34° with respect to said associated vertical axis.

* * * * *